United States Patent [19]

Powers et al.

[11] 4,445,357

[45] May 1, 1984

[54] PIPE PRESS

[75] Inventors: Joseph E. Powers; Ranaldo H. Grimoldi; Calvin C. Williamson; Alfred A. Bottini, all of Napa, Calif.

[73] Assignee: Kaiser Steel Corporation, Oakland, Calif.

[21] Appl. No.: 203,271

[22] Filed: Nov. 3, 1980

[51] Int. Cl.[3] ..... B21D 5/00

[52] U.S. Cl. ..... 72/399; 72/404; 72/412; 72/453.06; 72/455

[58] Field of Search ..... 72/412, 455, 404, 419, 72/420, 416, 453.06, 367, 368, 453.14, 441, 21, 399; 100/258 A, 258 R

[56] References Cited

U.S. PATENT DOCUMENTS

| | | | |
|---|---|---|---|
| 545,758 | 9/1895 | Aiken | 72/455 |
| 3,680,339 | 8/1972 | Hayakawa | 100/258 A |
| 3,892,122 | 7/1975 | Snell | 72/455 |
| 4,148,426 | 4/1979 | Midzutani | 72/368 |
| 4,206,699 | 6/1980 | Hemmelgarn | 72/453.06 |

FOREIGN PATENT DOCUMENTS

| | | | |
|---|---|---|---|
| 2331754 | 7/1973 | Fed. Rep. of Germany . | |
| 2455521 | 5/1976 | Fed. Rep. of Germany . | |
| 2630966 | 1/1978 | Fed. Rep. of Germany . | |
| 2247201 | 6/1978 | Fed. Rep. of Germany . | |
| 1302601 | 7/1962 | France | 72/455 |

*Primary Examiner*—Gene P. Crosby

*Attorney, Agent, or Firm*—James E. Toomey; James A. LaBarre

[57] ABSTRACT

A pipe press having a main press section and at least one end press section aligned with the main section for movement with and independently of the main section. The press is designed to accommodate elongate heavy gauge steel pipe blanks having lengths varying between the length of the main section and the combined composite length of the main and end sections. Because of the independence of the end section relative to the main section, the main section is loaded uniformly, even though a blank may be of a length less than the combined composite length of the press. The end press section is free to move axially relative to the main press section to accommodate elongation of a blank during operation of the press. Actuating cylinders for the press are arranged in paired sets extending transversely of the press dies to provide increased load capacity, without resorting to the use of extraordinarily large cylinders.

12 Claims, 7 Drawing Figures

PIPE PRESS

BACKGROUND OF THE INVENTION

The present invention relates to a press for forming large-diameter heavy-gauge steel pipe and, more particularly, is directed to such a press for forming preformed U-shaped blanks into an O-shape.

In the art of forming heavy-gauge, large-diameter steel pipe, an old practice is to first cut an elongate flat steel blank, then form the balnk into a U-shaped cross-section in what is known as a "U-ing Press", then form the U-shaped blank into an O-shaped cross-section in what is known as an "O-ing Press", and finally weld and finish the confronting edges of the O-shaped blank. A recent example of such a technique may be seen in U.S. Pat. No. 4,148,426.

The purpose of the present invention is to provide a press which is capable of providing and withstanding the extremely high forces which are required for the forming of large-diameter heavy-gauge steel pipe. For example, such pipe might have a wall thickness of an inch, a length of from 30 to 40 feet, and an outside diameter of from 18 to 40 inches. The pressing capacity of the press could be in the range of 90,000 tons, the exact capacity depending upon the yield strength of the plate and the wall thickness of the pipe.

A number of problems are encountered in providing a press of the capacity with which the present invention is concerned. One of the main problems is that the press must be capable of providing the extremely high press forces (e.g., 90,000 tons), while not being subject to destructive eccentric loading at these extremely high forces. Eccentric loading can occur whenever the length of the pipe blank is less than the length of the press, since one or both ends of the press will then be more lightly loaded than the center of the press and, thus, tend to move faster than the center of the press. Another form of destructive loading of the press can result from elongation of the pipe during the pipe formation process. Absent some accommodation for this elongation, distortion of the pipe and/or the imparting of destructive forces of the press can result. Still another problem in providing extremely large presses of the type with which the present invention is concerned is the matter of providing hydraulic press operating cylinders capable of generating the forces required, while at the same time being economically feasible and of a size which can be accommodated.

SUMMARY OF THE INVENTION

The press of the present invention accommodates pipe blanks of different lengths, within a predetermined range of maximum and minimum length, by providing a main section having a length substantially equal to said minimum length and an end section to at least one end of the main section. The main and end sections each have complemental arcuate dies adapted to forceably engage therebetween an elongate heavy-gauge steel pipe blank received within the press. Independent operating means are provided for the main and end sections to force the complemental dies of the respective sections toward one another to form blanks engaged between the dies into an arcuate cross-section. Control means are provided to operate the operating means so as to advance the dies of the main and end sections at the same rate, even though the end section may be more lightly loaded than the main section.

In its more specific aspects, the press of the invention provides a pair of end sections which are mounted for movement relative to the main section responsive to elongation of a pipe blank being formed. Other particular features of the invention relate to means to center a pipe blank longitudinally within the press and the provision of transversely paired hydraulic cylinders to provide the extremely high force required to move the complemental dies forceably into engagement with a blank being worked.

A principal object of the invention is to provide a high force pipe press so designed as to accommodate pipe blanks of variable lengths, without being subjected to destructive eccentric loading.

Another object of the invention is to provide such a press which can accommodate elongation of a pipe blank during the forming process, without adversely distorting the blank or subjecting the press to destructive forces.

Still another object of the invention is to provide such a press wherein sets of actuating cylinders are employed to increase the load capacity of the press, without resorting to the use of extraordinarily large cylinders.

Still another and more specific object of the invention is to provide such a press wherein variable length pipe blanks are longitudinally centered within the press to avoid eccentric loading of the press.

The foregoing and other objects will become more apparent when viewed in light of the following description and accompanying drawings.

DESCRIPTION OF THE PREFERRED EMBODIMENT

Figure 1:
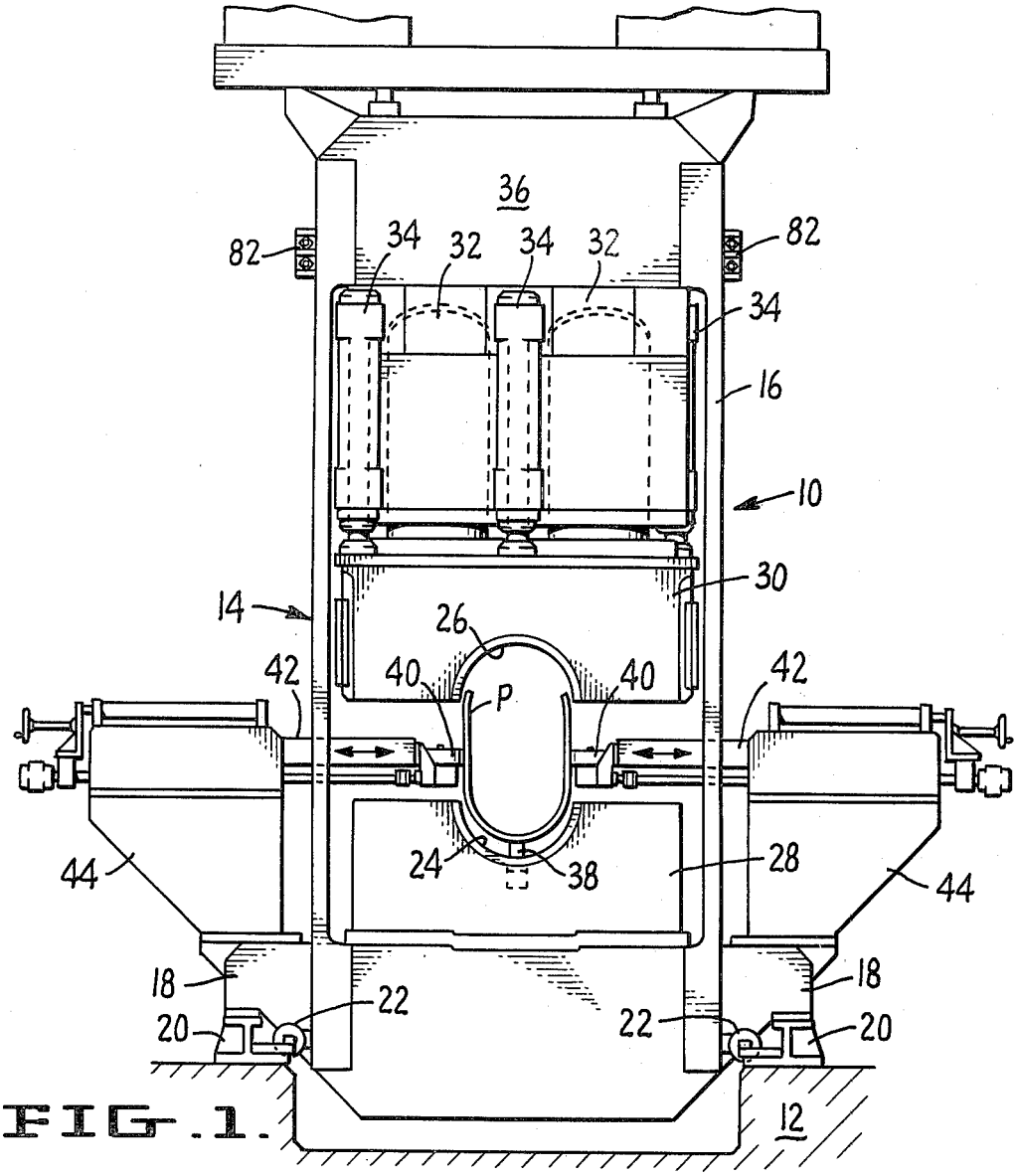
FIG. 1 is an end elevational view of a press constructed according to the present invention, illustrating the press with the dies separated and a pipe blank in the process of being positioned within the press.

Referring now to FIG. 1, the press is designated in its entirety by the numeral 10 and is shown supported on a foundation 12. As seen in FIG. 1, the viewer is looking directly at an end section 14 of the press (see FIG. 4). This section comprises a yoke 16 having side members with lateral supports 18 fixed thereto. The supports 18 slidably support the yoke 16 on pads 20 mounted on the foundation 12. Thus, the section 14 is free to move away from the main section of the press responsive to elongation of a pipe blank being forced within the press. Selectively extensible hydraulic cylinders 22 are coupled between the supports 18 and pads 20 to move the end section 14 back toward the main section of the press after disengagement of the section 14 from a pipe blank.

The pipe forming dies of the end section 14 are of complemental arcuate configuration and designated by the numerals 24 and 26, respectively. The lower die 24 is supported on a bolster 28 immovably supported on the yoke 16. The upper die 26 is carried by a bolster 30 slidably supported on the yoke 16 for movement toward and away from the bolster 28. Expansible hydraulic cylinders 32 comprised of pistons received within the cylinders are carried by the yoke 16 to selectively force the bolsters 30 into complemental engagement with the bolster 28, thus forcing a U-shaped blank engaged between the dies carried by the bolsters into an O-shaped configuration. The cylinders 32 are arranged in paired sets disposed transversely of the longitudinal dimension of the press. Selectively extensible return cylinders 34 are coupled between the yoke 16 and bolster 30 to retract the bolster and the die carried thereby after a pipe blank has been formed into an O-shaped configuration. A cross-member 36 forming part of the yoke 16 provides the mounting means for the cylinders 32 and 34.

As illustrated in FIG. 1, a pipe blank P is received within the press between the dies 24 and 26 and supported in an elevated condition by spring biased rollers 38. The rollers 38 are mounted within pockets in the bolsters (see FIG. 5) and function, together with similar rollers in the main section bolster, to support a pipe blank received within the press in an elevated condition until such time as the upper bolsters of the press are forced downwardly by the work cylinders. Upon so forcing the upper bolster downwardly, the rollers retract under the pressure imparted thereto by the pipe blank being formed.

Also as shown in FIG. 1, the blank P is engaged by lateral rollers 40 carried by selectively extensible and retractable arms 42. The arms 42 are carried by laterally mounted supports 44 for extension and retraction relative thereto. When in the extended condition shown in FIG. 1, the rollers 40 support the blank P in an upright condition. Conventional drive means are provided to selectively drive the rollers 40 so as to center the blank P longitudinally within the press. When the press is activated to forceably lower the upper bolsters, the arms 42 are automatically retracted to a position wherein both the arms and the rollers carried thereby are outside the path of travel of the upper bolsters FIG. 2 shows the rollers 42 so retracted.

Figure 2:
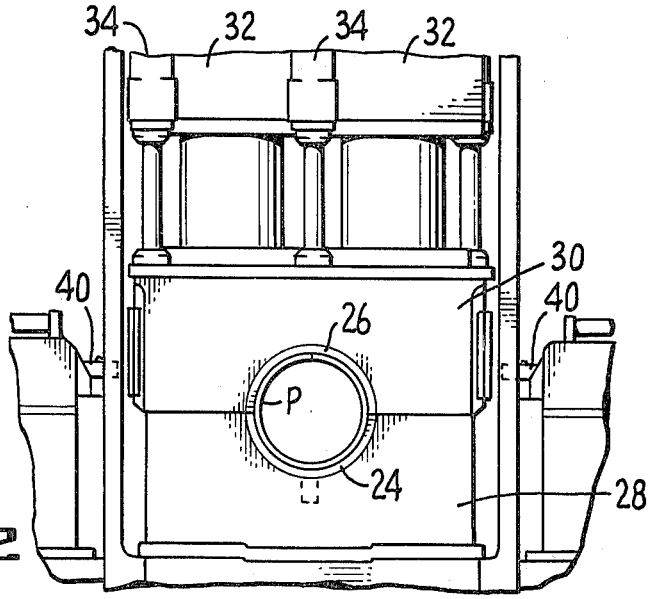
FIG. 2 is an end elevational view similar to FIG. 1, with parts thereof broken away, illustrating the press with the dies thereof forceably engaged with a pipe blank to form the blank into an O-shaped cross-sectional configuration.

As shown in FIG. 2, the cylinders 32 are expanded to force the bolster 30 downwardly and the dies 24 and 26 into complemental engagement. During the course of such expansion, the retraction cylinders 34 also expand and the rollers 38 contract. Forcing the dies 24 and 26 into complemental engagement forms the blank P into a circular cross-section, with the edges of the blank in confronting engagement.

Figure 5:
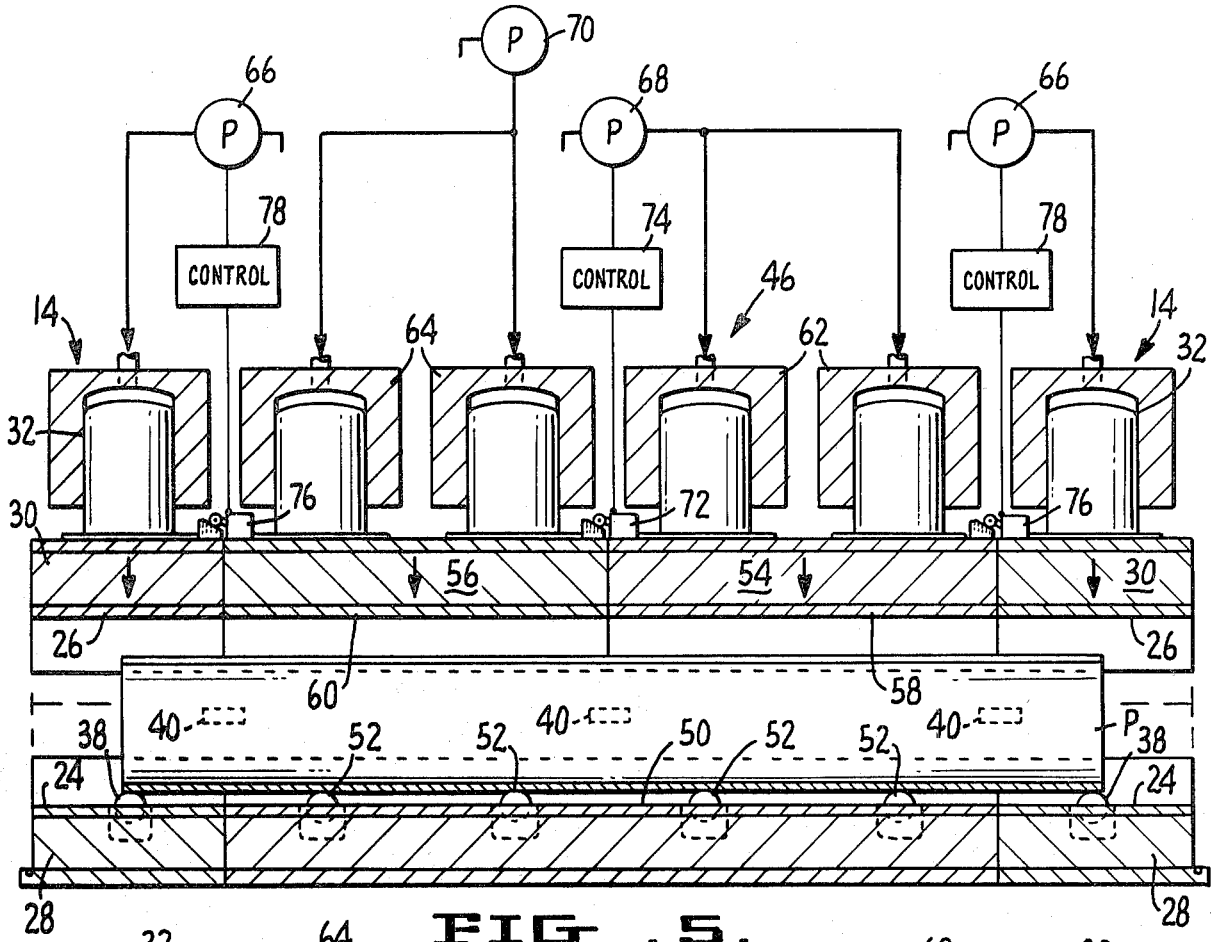
FIG. 5 is a cross-sectional side elevational view of the press, illustrating the press with the dies separated and a pipe blank in the process of being positioned within the press.

FIG. 5 illustrates the main and end sections of the press, in longitudinal cross-section, with the pipe blank P longitudinally centered within the press. As there seen, the pipe blank has a length less than the composite length of the press.

The press shown in FIG. 5 is comprised of two end sections, corresponding to the aforedescribed end section 14 and designated by like numerals, and the main section 46. The lower bolster 48 of the main section carries an arcuate die 50 and resiliently biased pipe blank supporting rollers 52. The rollers 52 operate and are designed to retract similarly to the aforedescribed rollers 38. The upper bolster of the main section is comprised of two similar parts 54 and 56 which carry arcuate dies 58 and 60, respectively. As shown, the bolster parts 54 and 56 are each provided with two sets of working cylinders similar to the cylinders 32 for the end sections of the press. The working cylinders for the bolster parts 54 and 56 are designated by the numerals 62 and 64.

Figure 6:
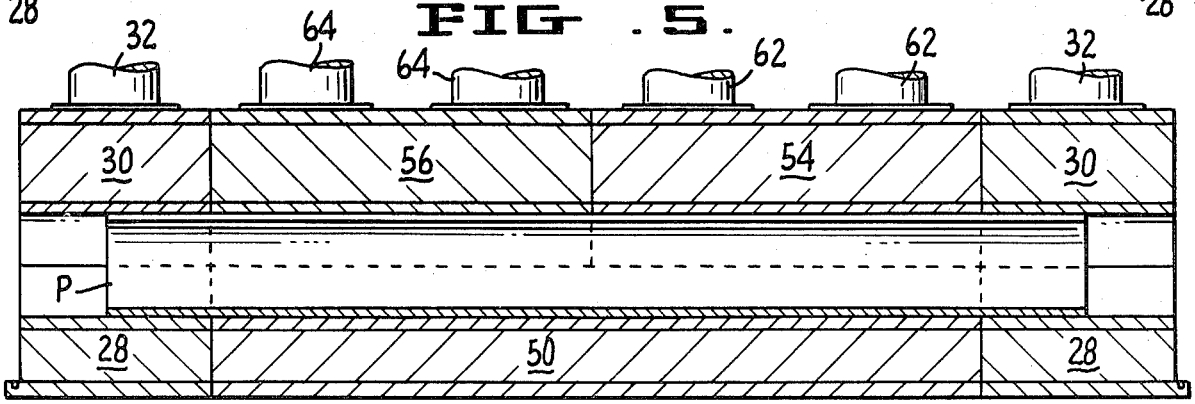
FIG. 6 is a cross-sectional elevational view similar to FIG. 5, with parts thereof broken away, illustrating the press with the dies forceably engaged with a pipe blank received within the press.

FIG. 5 also diagrammatically illustrates the pumping and control circuitry for activating the various working cylinders. The pumping circuitry comprises a separate pump 66 for the working cylinders of each end section 14 and separate pumps 68 and 70 for the working cylinders of the bolsters 54 and 56, respectively. The pump 70 and its associated working cylinders act as the lead operators for the press. A sensor 72 coupled between the bolsters 54 and 56 monitors, the aligned condition of these bolsters and, through a suitable conventional servo-control 74 controls the pump 68 so as to maintain alignment between the bolsters 54 and 56. The bolsters of the end sections 14 are maintained in alignment with the main section bolsters adjacent thereto by sensors 76 coupled between the main and end section bolsters and servo-controls 78 which operate responsive to the sensors to control the operation of the pumps 66. The servo-controlled operation of the end section bolsters assures that these bolsters will advance at the same rate as the main section bolsters, even though the end section bolsters may be more lightly loaded than the main section bolsters due to the presence of a relatively short pipe blank, such as that shown in FIGS. 5 and 6. Such operation is very advantageous, as compared to conventional presses wherein a single bolster or pair of bolsters is used to form the entire length of the pipe blank being worked. With such conventional presses, if the pipe blank has a length less than that of the press, the ends of the bolster or pair of bolsters are more lightly loaded than the center and tend to move faster than the center, thus subjecting the press to destructive eccentric loading and, possibly, adversely distorting the pipe blank.

Figure 7:
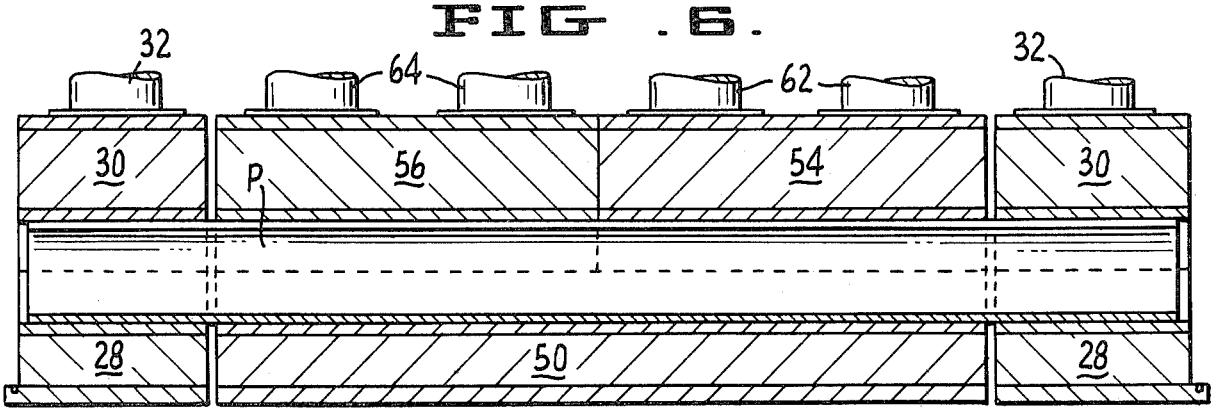
FIG. 7 is a cross-sectional side elevational view similar to FIG. 6, illustrating the dies forceably engaged with a pipe blank longer than that shown in FIG. 6, and the end sections of the press displaced outwardly relative to the main section.

The separate end sections and the mounting therefor permitting longitudinal movement of the sections relative to the main section also accommodate elongation of a pipe blank during formation by the press. This operation may be seen from FIG. 7 wherein a relatively long pipe blank $P_1$ is shown within the press and the end sections have moved outwardly relative to the main section responsive to elongation of the blank.

Figure 4:
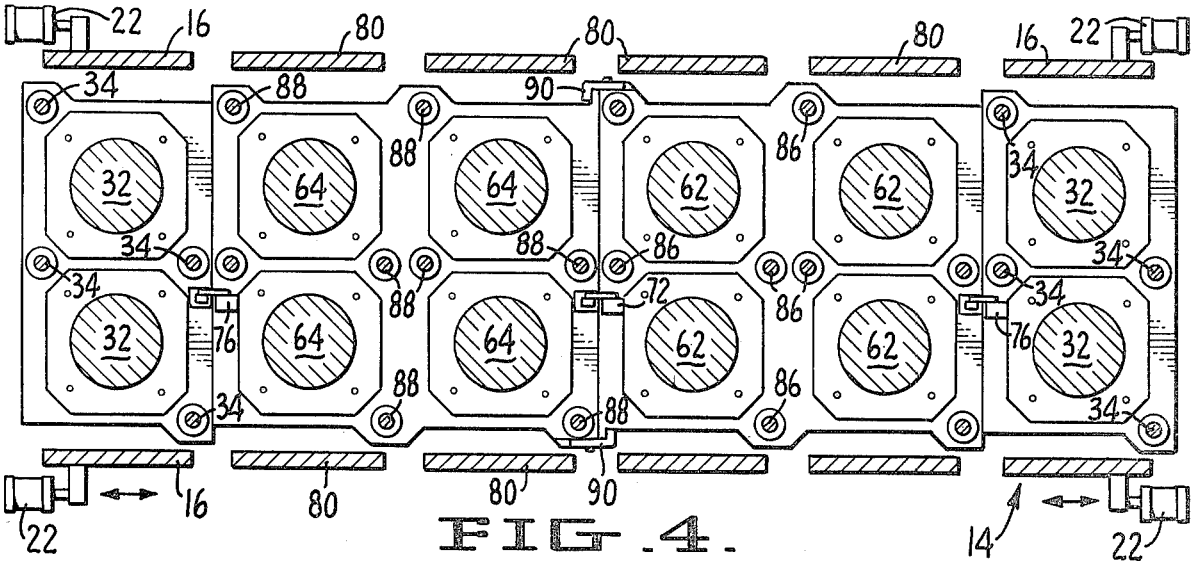
FIG. 4 is a cross-sectional view taken on the plane designated by lines 4—4, of FIG. 3.
Figure 3:
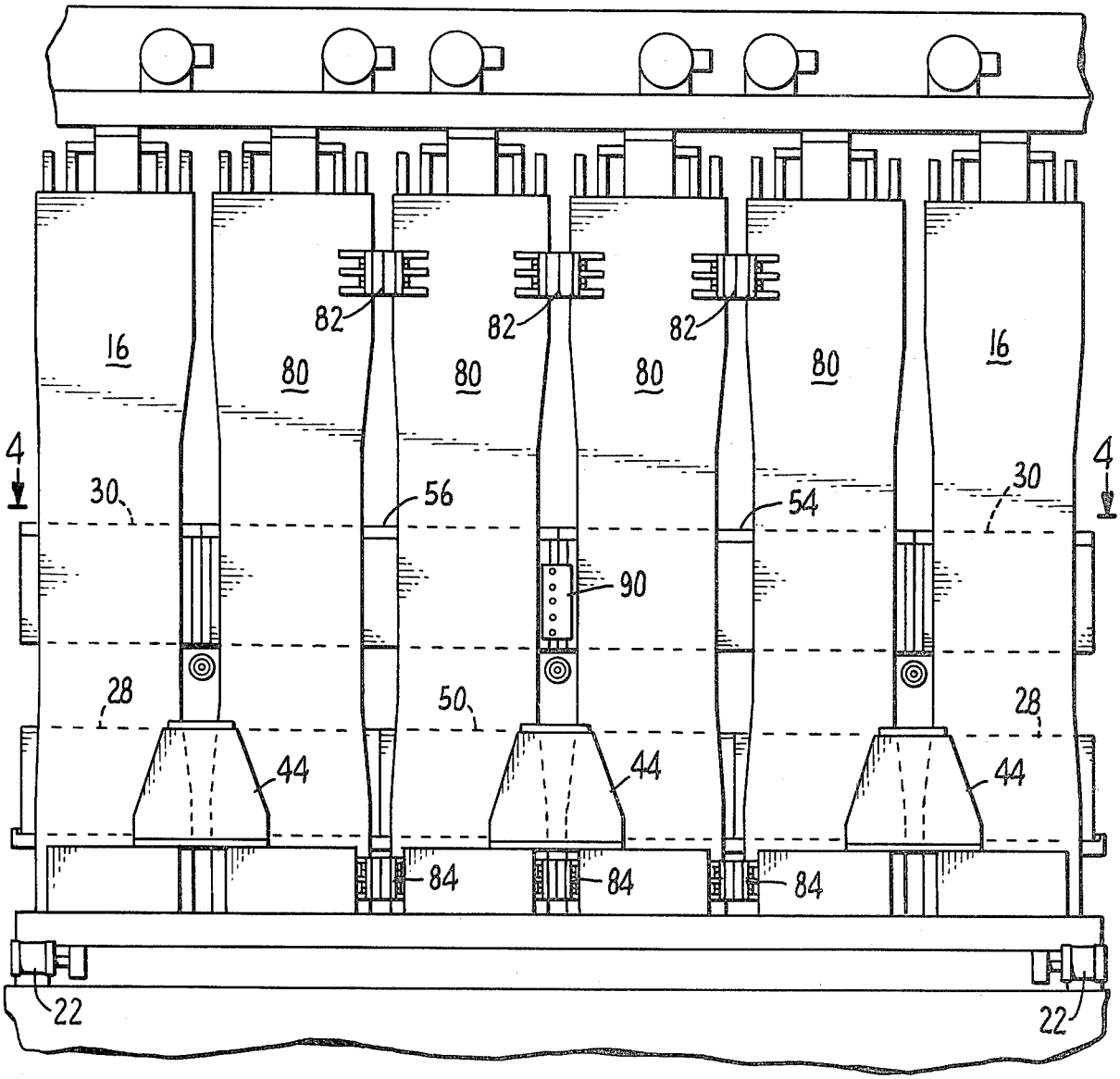
FIG. 3 is a side elevational view of the press, with the dies thereof separated for receipt of a pipe blank.

The main section of the press, as can be seen from FIGS. 3 and 4, is supported within yokes 80 which are tied together against separation by brackets 82 and 84. FIG. 4 also illustrates the return cylinders, designated 86 and 88, respectively, for the bolsters 54 and 56 and the manner in which the working cylinders are arranged in paired sets extending tranversely of the press. Guide brackets 90, as may also be seen from FIGS. 3 and 4, serve to slidably interconnect the bolsters 56 and 54 to maintain the bolsters in alignment.

OPERATION

The press is designed to accommodate pipe blanks within a predetermined range of maximum and minimum length. At the minimum limit of this range, the blank should have a length no less than the length of the dies in the main section of the press. At the maximum limit of this range, the blank should have a length no greater than the composite length of dies in the main and end sections of the press. By maintaining the pipe blanks within this range and centering the blanks longitudinally relative to the press, it will always be assured that the bolsters of the main section are fully loaded during operation of the press.

In operation, the press is first conditioned by extending the return cylinders 34, 86 and 88 to separate the bolsters. The arms 42 are then extended to position the rollers 40 for guiding engagement with the pipe blank. A preformed blank of U-shpaed cross-section is then directed into one end of the press and centered longitudinally of the press by operation of the rollers 40. Centering can be manually controlled by the operator or servo-controlled through a conventional sensing mechanism. Thereafter, the working cylinders of the bolsters are extended and the arms 42 are simultaneously retracted. Extension of the working cylinders functions to move the dies into complemental engagement and force the pipe blank into an O-shaped configuration, as may be seen from FIG. 2. After so forming the pipe, pressure on the working cylinders is released and the return cylinders 34, 86 and 88 are extended to lift the bolsters and release the pipe blank for ejection from the press. Ejection is generally achieved by pushing the formed blank out with the next blank to be formed. The rollers 38 and 52 serve to facilitate both the entry and ejection of pipe blanks.

If the end sections of the press have been outwardly displaced due to elongation of a pipe blank formed within the press, these end sections are returned to juxtaposition with the main section prior to commencement of the next forming operation. Such return is achieved by extension of the cylinders 22.

CONCLUSION

While a preferred embodiment of the invention has been illustrated and described, it should be understood that the invention is not intended to be limited to the specifics of that embodiment. For example, it is anticipated that the features of the inventive press may find utility in presses for working on other than preformed U-shaped blanks.

What is claimed is:

1. A press for forming elongate heavy gauge steel pipe blanks into an arcuate cross-section, said press being adapted to accomodate blanks of different lengths within a predetermined range of maximum and minimum length and comprising: a main section of a length substantially equal to said minimum length, said section having complemental arcuate dies adapted to forceably engage therebetween an elongate heavy gauge steel pipe blank; an end section disposed to at least one end of and in alignment with said main section, and movable relative thereto, said end section being adapted to receive the end of a blank extending beyond the main section and having complemental arcuate dies adapted to forceably engage said end therebetween; independently actuatable operating means for the main and end sections to separately force the complemental dies of said respective sections toward one another to form blanks engaged between said dies into an arcuate cross-section; and, control means for said operating means to advance the die of the main and end sections at the same rate.

2. A press according to claim 1 wherein: end sections are disposed to either end of and in alignment with the main section, said end sections having a composite length at least equal to the difference between said maximum and minimum lengths and each having complemental arcuate dies adapted to forceably engage the end of a pipe blank therebetween, the independent operating means are adapted to force the complemental dies of said respective end sections toward one another to form blanks engaged between said dies into an arcuate cross-section; and, the control means functions to advance the dies of said respective end sections at the same rate as the dies of the main section.

3. A press according to claim 1 for forming elongate heavy gauge steel pipe blanks of a preformed U-shaped cross-section into an O-shaped cross-section, wherein the complemental dies of the main and end sections are concave and when forced into full engagement with a blank engaged therebetween define a closed circular confinement for the blank.

4. A press according to claim 3 wherein the complemental dies of the main and end sections are vertically spaced and receive the blanks therebetween with the U-shape of the blanks in an upright condition and wherein the press further comprises driven rollers engageable with the sides of a blank received between the dies, said rollers being operable in advance of forceful engagement of the blank by the dies to move the blank longitudinally within the press.

5. A press according to claim 2 further comprising means to center a blank in longitudinally centered position relative to said main section.

6. A press according to claim 5, including means to support a blank for longitudinal movement within the press; and wherein the means to center a blank comprises driven rollers engageable with a blank when so supported to move the blank longitudinally within the press.

7. A press according to claim 1 wherein the complemental dies of the main section are carried by opposed bolsters, at least one of which is moveable toward the other responsive to the operating means; and the operating means for the main section comprises a plurality of sets of hydraulic cylinders, each said set being engaged with and extending transversely of the moveable bolster of said section.

8. A press according to claim 7 wherein the complemental dies of the end section are carried by opposed bolsters, at least one of which is moveable toward the other responsive to the operating means; and the operating means for the end section comprises at least one set of hydraulic cylinders engaged with and extending transversely of the moveable bolster of said section.

9. A press according to claim 8 wherein said independently actuatable operating means for the main and end sections each includes a pump for supplying hydraulic fluid to the hydraulic cylinders for its associated section, and wherein said control means includes means for sensing relative movement between said main and end sections and means responsive to said sensing means for controlling the speed of the pump associated with one of said sections.

10. The press of claim 1 wherein said control means includes means for sensing relative displacement between said main and end sections in the direction of advancement of said dies.

11. A press for forming elongate heavy gauge steel pipe blanks into an arcuate cross-section, said press being adapted to accomodate blanks of different lengths within a predetermined range of maximum and minimum length and comprising: a main section of a length substantially equal to said minimum length, said section having complemental arcuate dies adapted to forceably engage therebetween an elongate heavy gauge steel pipe blank; an end section disposed to at least one end of and in alignment with said main section, said end section being adapted to receive the end of a blank extending beyond the main section and having complemental arcuate dies adapted to forceably engage said end therebetween; means mounting the end section for movement away from the main section responsive to elongation of a pipe blank being formed by said sections; independent operating means for the main and end sections to force the complemental dies of said respective sections toward one another to form blanks engaged between said dies into an arcuate cross-section; and, control means for said operating means to advance the dies of the main and end sections at the same rate.

12. A press for forming elongate heavy gauge steel pipe blanks into an arcuate cross-section, said press being adapted to accomodate blanks of different lengths within a predetermined range of maximum and minimum length and comprising: a main section of a length substantially equal to said minimum length, said section having complemental arcuate dies adapted to forceably engage therebetween an elongate heavy gauge steel pipe blank; an end section disposed at either end of and in alignment with said main section, said end sections having a composite length at least equal to the difference between said maximum and minimum lengths and each having complemental arcuate dies adapted to forceably engage the end of a pipe blank therebetween; means mounting said end sections for movement away from the main section responsive to elongation of a pipe blank being formed by said sections; independent operating means for the main and end sections to force the complemental dies of said respective sections toward one another to form blanks engaged between said dies into an arcuate cross-section; and, control means for said operating means to advance the dies of said respective end sections at the same rate as the dies of the main section.

* * * * *